United States Patent [19]

Coralli et al.

[11] 4,136,540

[45] Jan. 30, 1979

[54] ROLLING GATES CYLINDER LOCK

[75] Inventors: Giorgio V. Coralli; Alessandro Brunelli, both of Bologna, Italy

[73] Assignee: Viro Innocenti S.p.A., Bologna, Italy

[21] Appl. No.: 824,130

[22] Filed: Aug. 12, 1977

[51] Int. Cl.[2] ..... E05B 63/04

[52] U.S. Cl. ..... 70/100; 70/134; 70/462; 70/DIG. 66; 292/142

[58] Field of Search ..... 70/81, 100, 120, 129, 70/134, 370, 462, DIG. 11, DIG. 66; 292/51, 39, 142, 160, 172, DIG. 53

[56] References Cited

U.S. PATENT DOCUMENTS

| | | | |
|---|---|---|---|
| 470,474 | 3/1892 | Colley | 70/DIG. 66 X |
| 963,632 | 7/1910 | Nefflenetal | 70/DIG. 66 X |
| 1,299,199 | 4/1919 | Lypka | 70/129 |
| 1,330,650 | 2/1920 | Pehel | 70/134 |
| 1,378,622 | 5/1921 | Sarbij | 292/142 |
| 1,814,302 | 7/1931 | Falk | 70/134 |
| 1,994,095 | 3/1935 | Caldwell | 70/134 X |
| 2,261,353 | 11/1941 | Fedele | 70/120 |
| 2,721,092 | 10/1955 | Simmons | 292/172 |
| 2,752,445 | 6/1956 | Navarrete | 70/120 X |

FOREIGN PATENT DOCUMENTS

| | | | |
|---|---|---|---|
| 1357509 | 2/1964 | France | 70/129 |
| 2250370 | 5/1975 | France | 292/142 |
| 277205 | 9/1930 | Italy | 70/134 |

*Primary Examiner*—Thomas J. Holke
*Attorney, Agent, or Firm*—Pollock, Vande Sande & Priddy

[57] ABSTRACT

A cylinder lock, particularly a rolling gates cylinder lock, which may be mounted, at will, as a right or a left lock. The lock is provided with a sliding bolt which is guided for its movement into locking and unlocking position by a guide block housed inside of the lock casing. To the central portion of the sliding bolt a rack bar is secured, in mesh with the pinion operated by the cylinder of the lock. The said rack bar acts as an abutment member in cooperation with the lock casing in order to limit the sliding movement in both directions of the sliding bolt. Means are provided for fastening the said lock to a rolling gate by using nuts and bolts.

1 Claim, 3 Drawing Figures

II
III
22
201
1
17
107
8
7
8
17
24
2
2
5
5
3
101
4
207
101
9
10
8
8
25
17
201
17
23
II
III 201
22
19
8
1
7
20
15
3
107
301
5
13
6
112
4
12
207
14
10
11
114
9
21
16
23
19
8
307
13
201

201
22
1
17
20
19
18
15
3
107
301
4
12
7
207
9
19
23
18
17
201

ROLLING GATES CYLINDER LOCK

FIELD OF THE INVENTION

This invention relates to a cylinder lock for rolling gates, rolling shutters or the like, in which the gate is to be locked at both its left and right side, in order to assure safe and reliable locking.

BACKGROUND OF THE INVENTION

Hitherto, it was necessary to manufacture for said gates a special left locking and a special right locking lock, i.e. one lock provided with a bolt extending at the left side, and one lock provided with a bolt extending at the right side of the lock casing. This not only had many disadvantages, but also added to the manufacturing costs, moreover, when one lock became defective, it was almost always necessary to buy a new pair of locks.

SUMMARY OF THE INVENTION

This invention aims to obviate to the mentioned drawbacks of prior art locks of the kind referred to above. According to the invention, this object is obtained by providing in a cylinder lock comprising a casing, a sliding bolt mounted in said casing, a key operated cylinder and means for operating through said cylinder the said bolt, a guide block housed inside of said casing and provided with a longitudinal slot extending for the whole length of said block, two passages into two opposite side walls of the casing into alignment with the said slot of the guide block; a sliding bolt slidably mounted into said slot for movement into locking and unlocking position; a rack bar secured to the central portion of said sliding block, the said rack bar meshing with a pinion operated through the cylinder of the lock, the said rack bar acting also as an abutment member in cooperation with the casing of the lock, in order to limit the movement of the sliding bolt in both directions.

The above and other features of the invention will become clearer from the following specification made with reference to the annexed drawing, in which a preferred embodiment of the invention is shown.

DESCRIPTION OF THE PREFERRED EMBODIMENT OF THE INVENTION

Figure 1:
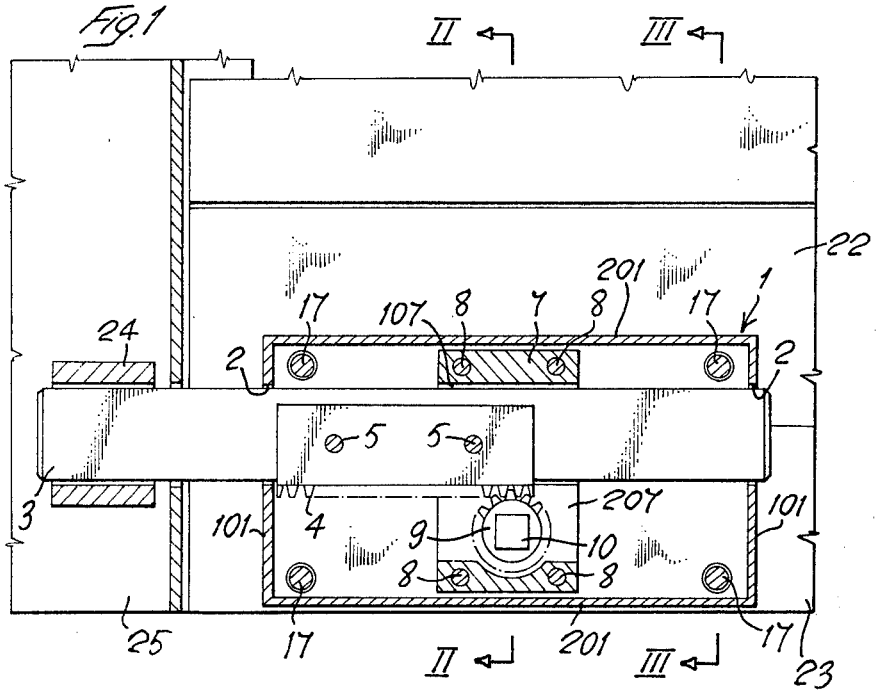
FIG. 1 is a plan view of a cylinder lock according to the invention, with the bottom wall of the lock casing sectioned away.
Figure 2:
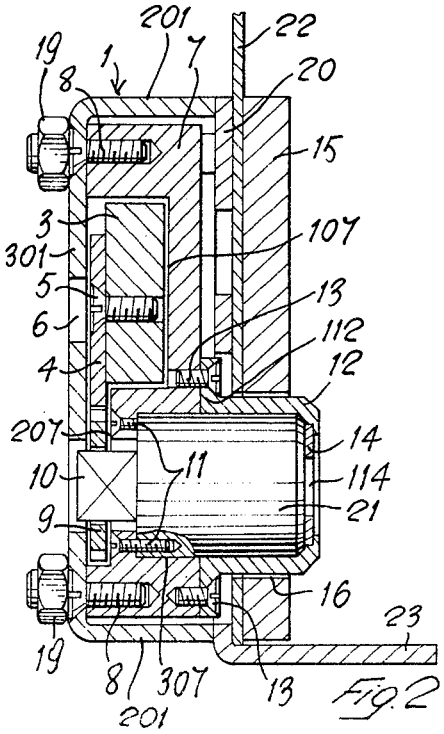
FIG. 2 is a cross sectional view of the cylinder lock of FIG. 1, sectioned along line II—II of FIG. 1.
Figure 3:
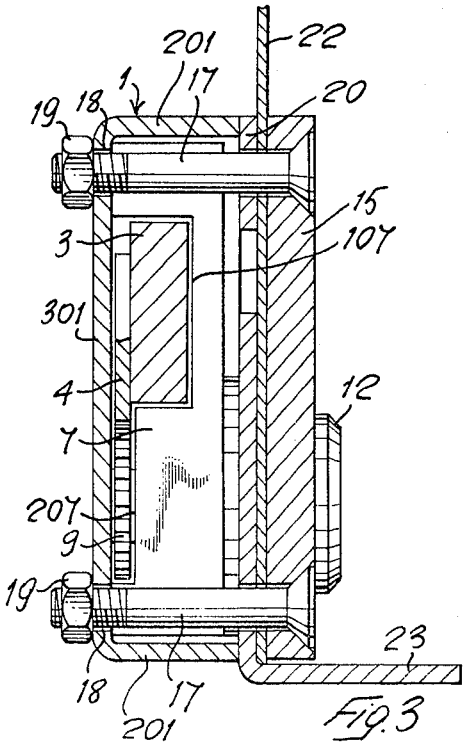
FIG. 3 is a cross sectional view of the cylinder lock of FIG. 1, sectioned along line III—III of FIG. 1.

With reference to the drawing, the lock shown comprises a casing 1 provided with side walls 101 and 201 and with a bottom wall 301.

Inside of the casing 1, a guide block 7 is secured to the casing bottom wall 301 by means of screws 8. The guide block 7 is provided with a longitudinal slot 107 in which the sliding bolt 3 is guided for sliding movement between locking and unlocking position. The ends of the sliding bolt 3 extend through casing 1 through the openings 2 formed in the side walls 101. To the middle portion of the bolt 3 a rack bar 4 is secured, by means of screws 5. The block 7 is also provided with a second slotted portion 207, in which the pinion 9 is accomodated. The said pinion is in mesh with the toothed portion of the rack 4. Pinion 9 is keyed to the square element 10, which is connected to the rotating plug (not shown) of the operating cylinder 21 of the lock. The rear end of cylinder 21 is housed in a circular recess 307 formed in block 7, and is secured thereto by means of screws 11. Recess 307 is provided centrally at its bottom with a through hole, through which square 10 extends. The front end of cylinder 21 is covered by a protective disc 14, provided with the key-hole 114, and the front end portion of the cylinder 21 is further capped by a protective cap 12, provided with a flanged portion 112 which is secured by means of screws 13 to block 7.

ASSEMBLY OF THE DESCRIBED DEVICE TO A ROLLING GATE

The assembly of the described device to the lower slat 22 of a rolling gate will be now described.

The cylinder lock contained in casing 1 is disposed at the desired corner portion of the lower slat 22 of the rolling gate, against the inside surface of said slat, with the front portion of the cylinder 21 and of its cap 12 extending outwardly through a bore formed in said slat 22 and in the associated abutment bar 23 secured to the lower edge of the slat 22. Spacers 20, of a thickness which is equal to the thickness of the 23, are disposed between the upper portion of casing 1 and the inner surface of slat 22. A counter plate 15, provided with a bore 16 for the passage of cylinder 21 and associated cap 12, is placed against the outside surface of slat 22, in correspondence of lock casing 1, and the said plate 15, the interposed slat 22 and the cylinder lock in casing 1 are clamped together by means of stud bolts 17 extending from the outside of gate 22 through suitable bores formed in plate 15, in slat 22, in the spacers 20, in bar 23 and in bottom wall 301 of casing 1, and the said members are tightened together by means of nuts 19 screwed onto the threaded end portions 18 of bolts 17.

Thereafter the selvage 24 is secured in position to the wall 25.

OPERATION OF THE DESCRIBED DEVICE

The operation of the described device will be evident. The cylinder lock may be used at will as a right latching lock or a left latching lock. Bolt 3 may be easily replaced or adjusted by simply unscrewing screws 5, by means of a screw driver inserted through bores 6 in bottom wall 301, thus permitting its adjustment as a left-hand or right-hand latch bolt.

Further, rack bar 4 acts as a stop limiting the movement in both directions of bolt 3, by abutment against the side walls 101 of casing 1.

In addition, assembly of the lock by means of plate 15 and bolts 17 is greatly simplified, yet reliable, and once assembled the lock may be easily disassembled, e.g., if its replacement becomes necessary.

We claim:

1. A lock comprising a casing open at its top and provided with a bottom wall, two longitudinal walls integral with said bottom wall and two side walls integral with said bottom wall and said longitudinal walls; a guide block secured by means of screws to the bottom wall of said casing; said guide block being provided with a first longitudinal slot on its side facing said bottom wall, and with a second slot on the same side and communicating with said first slot; a circular recess formed in said block on its side opposite to the said slotted side, the bottom of said recess being provided with a through passage in communication with said second slot; two apertures in the side walls of said casing in alignment with the first slot of said block; a sliding bolt disposed in said first slot, with its ends projecting out of said apertures in the side walls of the casing; a rack bar inside of said casing secured by means of screws to said sliding bolt; a lock cylinder mounted with its rear end in said circular recess in the guide block and secured thereto by means of screws, said cylinder being provided with a rotating key-operated plug provided with a square extension extending through said through passage formed in the bottom of said recess in said second slot; a pinion housed in said second slot and keyed to said square extension, said pinion being in mesh with the toothed portion of said rack bar; a cylindrical cap member disposed around the fore end of said cylinder projecting from said recess in the guide block, said cap member being secured to the guide block by means of screws; a counter plate having a plane contour conforming to the plane contour of said casing, and provided with a bore for the passage of the said cylinder portion and the cap member thereof, and nut and stud bolt means for clamping together said plate and said lock casing with interposed gate element.

* * * * *